US011746479B2

(12) United States Patent
Buschmann et al.

(10) Patent No.: US 11,746,479 B2
(45) Date of Patent: Sep. 5, 2023

(54) ROAD PAVER WITH COMPACTION CONTROL

(71) Applicant: JOSEPH VOEGELE AG, Ludwigshafen/Rhein (DE)

(72) Inventors: Martin Buschmann, Neustadt (DE); Ralf Weiser, Ladenburg (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 203 days.

(21) Appl. No.: 17/150,121

(22) Filed: Jan. 15, 2021

(65) Prior Publication Data

US 2021/0222379 A1 Jul. 22, 2021

(30) Foreign Application Priority Data

Jan. 16, 2020 (EP) ..... 20152122

(51) Int. Cl.
*E01C 19/48* (2006.01)

(52) U.S. Cl.
CPC ..... *E01C 19/4853* (2013.01)

(58) Field of Classification Search
CPC ..... E01C 19/4853; G06F 3/0482
USPC ..... 404/72–85, 118
See application file for complete search history.

(56) References Cited

U.S. PATENT DOCUMENTS 6,520,715 B1 2/2003 Smith
7,172,363 B2 2/2007 Olson et al.
8,371,769 B2 2/2013 Worsley et al.
8,655,593 B1 * 2/2014 Davidson ..... G08G 1/04 318/443
8,702,344 B2 4/2014 Hanfland
8,807,866 B2 8/2014 Buschmann et al.
9,790,648 B2 10/2017 Buschmann et al.
2010/0129152 A1 * 5/2010 Taylor ..... E01C 23/07 404/75
2013/0189031 A1 * 7/2013 Fritz ..... B60W 30/18 404/72

(Continued)

FOREIGN PATENT DOCUMENTS

CN 1743552 A 3/2006
CN 102220738 A 10/2011

(Continued)

OTHER PUBLICATIONS

European Search Report dated Jul. 8, 2020, Application No. 20152122.6-1002—Applicant Joseph Voegele AG, 7 Pages.

(Continued)

*Primary Examiner* — Raymond W Addie
(74) *Attorney, Agent, or Firm* — BROOKS KUSHMAN P.C.

(57) ABSTRACT

A road paver comprises a paving screed, wherein the paving screed comprises a tamper, and the road paver further comprises a GNSS receiver and a material conveyor. In addition, the road paver comprises an electronic control system, which comprises a memory and a data processor, wherein digital construction data, in particular a target height profile of a road surface to be paved, a target layer thickness of paving material and, if necessary, a height profile of a roadbase are stored in the memory. The control system is configured to automatically control compaction performance of the paving screed as a function of the target layer thickness in order to pave the paving material for the respective local coordinate point of the road paver determined by the GNSS receiver.

15 Claims, 5 Drawing Sheets

(56) References Cited

U.S. PATENT DOCUMENTS

| | | | | |
|---|---|---|---|---|
| 2015/0267361 | A1* | 9/2015 | Horn | G01B 21/08 33/700 |
| 2015/0284918 | A1* | 10/2015 | Fritz | E01C 23/127 299/1.5 |
| 2016/0060820 | A1* | 3/2016 | Berning | E01C 19/05 404/84.2 |
| 2016/0177517 | A1* | 6/2016 | Engels | E01C 19/4893 404/75 |
| 2017/0228108 | A1* | 8/2017 | Marsolek | G07C 5/008 |
| 2020/0018634 | A1 | 1/2020 | Fickeisen et al. | |

FOREIGN PATENT DOCUMENTS

| | | | |
|---|---|---|---|
| CN | 102828459 | A | 12/2012 |
| CN | 105780634 | A | 7/2016 |
| EP | 2 325 392 | A2 | 5/2011 |
| EP | 2 366 832 | A1 | 9/2011 |
| EP | 3 594 409 | A1 | 1/2020 |

OTHER PUBLICATIONS

European Search Report Application No. 20152122.6-1002 dated Jul. 8, 2020, Letter identifiers that indicate relevance of the cited documents (see p. 2 of the European Search Report).
EP 2 325 392 A2, U.S. Pat. No. 9,790,648 B2.
EP 2 366 832 A1, U.S. Pat. No. 8,807,866 B2.
EP 3 594 409 A1, US 2020/0018634 A1.
Chinese Office Action (with English Machine Translation) dated May 6, 2022, Application No. 202110060648.8, 14 Pages.

* cited by examiner

ROAD PAVER WITH COMPACTION CONTROL

CROSS-REFERENCE TO RELATED APPLICATIONS

This application claims foreign priority benefits under 35 U.S.C. § 119(a)-(d) to European patent application number EP 20152122.6, filed Jan. 16, 2020, which is incorporated by reference in its entirety.

TECHNICAL FIELD

The present disclosure refers to a road paver and a method for operating a road paver.

BACKGROUND

In road construction, one often finds a roadbase, i.e., a substrate prepared for the application of a road surface, which still has irregularities. Consequently, these irregularities must be leveled out when the road surface is paved in order to obtain a level road surface. For this purpose, it has been known up to now to control the leveling cylinders of a road paver in order to vary the layer thickness of the road surface by means of conventional leveling, so that depressions with a thicker layer of paving material and elevations with a thinner layer of paving material are leveled, so that in all a completely level road surface is paved. This has proved disadvantageous, however, as subsequent compaction by a roller again causes irregularities in the paved road surface, as the thicker layers have a higher rolling dimension, i.e., an absolute reduction in layer thickness due to the compaction performance of the roller, than thinner layers.

It is known from US 2010/0129152 A1 that the problem of a higher rolling dimension for thicker layers of material can be countered by increasing the thickness of the paving material in areas of depressions in the roadbase more than in areas of elevations in the roadbase, i.e., the road surface is paved irregularly by the paver. Digital roadbase data are used for control purposes. However, the method described has disadvantages, such as the sometimes difficult to control change of the paving height, especially when the roadbase height is changed at small intervals.

SUMMARY

An object of the present disclosure is to provide a road paver with an improved control system and an improved method of operating a road paver.

The object is solved by a road paver and a method of operating a road paver according to the disclosure.

A road paver according to the disclosure comprises a paving screed, wherein the paving screed comprises a tamper. The road paver further comprises a Global Navigation Satellite System (GNSS) receiver, a material conveyor and an electronic control system comprising a memory and a data processor. The memory stores digital construction data, in particular a target height profile of a road surface to be paved, a target layer thickness of the paving material and, if necessary, a height profile of a roadbase. The control system is configured to automatically control the compaction performance of the paving screed in relation to the target layer thickness in order to pave the paving material for the respective local coordinate point of the road paver determined by the GNSS receiver.

In the case of an irregular roadbase, the target layer thickness can be varied so that a level surface or level road surface is obtained. The compaction performance of the paving screed can now be controlled in such a way that where the roadbase has a depression, i.e., where a thicker layer has to be paved, the material is paved at a higher degree of compaction than in an area of an elevation of the roadbase and thus at a lower layer thickness. The compaction degrees are selected in such a way that all areas are compressed by the same absolute value during subsequent compaction by a roller, i.e., the rolling dimension is the same everywhere, i.e., the areas of higher layer thickness are compressed and compacted less by the roller in percentage terms than the areas of lower layer thickness. This means that the material can be paved with a level surface and this regularity is also maintained during subsequent compaction, as the road surface lowers to the same extent everywhere.

A pre-compaction degree for a respective local coordinate point may be stored in the memory of the control system. This means that the values do not have to be calculated first, but the corresponding control signals can be transmitted directly to the components of the road paver relevant for setting the compaction degree.

In a practical version, the road paver has a sensor for measuring an actual layer thickness of paving material, with the control system configured to calculate a deviation of the actual layer thickness from the target layer thickness. A feedback mechanism allows the paving material to be paved exactly to the desired target layer thickness, i.e., until the deviation between actual and target layer thickness is zero. Ultrasonic sensors, mechanical tactile sensors, laser sensors or other suitable sensors, which work with or without an external reference point, can be used for this purpose.

The control system may be configured to automatically adjust the compaction performance of the paving screed by controlling the tamper frequency and/or tamper stroke. The tamper stamps the mix under the paving screed, thus ensuring a sufficient quantity of paving material and compacting it.

In an advantageous version, the paving screed includes a screed plate and/or pressure bar and the control system is configured to automatically adjust the compaction performance of the paving screed by controlling the vibration frequency and/or amplitude of the screed plate and/or pressure bar pressure. These devices allow high compaction levels to be achieved.

In another variant, the control system is configured to automatically adjust the compaction performance of the paving screed by controlling the paving speed. The paving speed determines the duration of action of the compaction units tamper, screed plate and pressure bar and is particularly suitable for adapting the settings to a required pave width.

A method according to the disclosure for the operation of a road paver, in particular a road paver according to one of the embodiments described above, comprises the following method steps:

- storage of digital construction data, in particular a height profile of a roadbase, in a memory of an electronic control system,
- storage of digital construction data, in particular a target height profile of a road surface to be produced and a target layer thickness of a paving material for the local coordinate points of the roadbase, and
- paving of the paving material, wherein the current position of the road paver is determined by means of a GNSS receiver and the electronic control system automatically controls the compaction performance of the paving screed as a function of the target layer thickness in order to pave the paving material at a respective pre-compaction degree.

As mentioned above, this allows the paving material to be paved with a known pre-compaction degree that depends on the layer thickness. In this way, the loss of height due to post-compaction with a roller can also be predicted and the paving material can be paved with a layer thickness that is greater by the rolling dimension. This ensures that the rolling dimension is the same for all local coordinate points. For the calculation and control of the compaction performance, not only the target layer thickness of the respective local coordinate point or the current position can be taken into account, but also one or a plurality of target layer thicknesses of the upcoming local coordinate points, i.e., those located further ahead in the direction of travel. Likewise, one or a plurality of past values can also be used to ensure a continuous course of the surface.

Paving the material to be paved may involve detecting an actual layer thickness by means of a sensor and calculating a difference between the actual layer thickness and the target layer thickness, and the road paver may be automatically controlled to minimize the difference. In this way, parameters of the paving operation, namely layer thickness and pre-compaction degree, can be monitored and controlled automatically. This allows the paver operator to devote more attention to other tasks to be carried out in the paving operation. It is conceivable to show the current values of the paving parameters, in particular layer thickness and pre-compaction degree, on a display so that an operator can read them and also intervene in the automatic control system and change the parameters. Since the course of the target layer thickness, especially the values still following with respect to the current position, and compaction degree along the paving path is known, the control system automatically makes all changes to the settings, and corrections are usually only made as part of an automatic feedback mechanism for reaching the target values, which already prevents undesired deviations from the target values.

In an advantageous variant, the electronic control system automatically adjusts the compaction performance of the paving screed by controlling the tamper frequency and/or tamper stroke. The tamper can be regarded as the first stage of screed compaction. On the one hand, it influences the amount of paving material passing under the screed. On the other hand, it pre-compacts the paving material.

In another advantageous variant, the control system automatically adjusts the paving screed's compaction performance by controlling the vibration frequency and/or amplitude of the screed plate and/or pressure bar pressure. This enables high compaction degrees to be achieved even with thicker layers.

In another variant, the control system automatically adjusts the paving screed's compaction performance by controlling the paving speed. In particular, the paving speed can be adjusted in relation to the target layer thickness.

In a practical variant, the digital construction data, which includes the height profile of the roadbase, is transferred from an external data processing system to the memory of the electronic control system by radio or cable connection at the beginning of the procedure. The external data processing system can be, for example, a laptop, tablet, cell phone, stationary personal computer, server or similar, and the radio transmission can take place via RFID, Bluetooth, WLAN, mobile phone connection or similar. In this way, the roadbase data, which, for example, has previously been determined by means of surface scanning with an independent vehicle, can be analyzed, processed and supplemented with calculated data dependent on it. This can take place, for example, at a central location for monitoring the construction site and the data can then be transmitted to the road paver on the construction site.

In another variant, an external data processing system is used to calculate the respective compaction performance as a function of the determined target layer thickness and/or to assign the respective compaction performance to a location coordinate point as a function of the target layer thickness and the data is then transferred to the memory of the electronic control system. The compaction performance and thus the pre-compaction degree can therefore always be calculated or taken from a table-like data record. Calculation by means of an external system has the advantage that the necessary equipment can be easily provided and the data can also be displayed, analyzed and processed by means of appropriate EDP equipment.

In a further variant, the electronic control system calculates the respective compaction performance depending on the determined target layer thickness and/or assigns the respective compaction performance to a local coordinate point depending on the target layer thickness. These and other calculations can thus be carried out directly on the road paver. This could even be done during operation for the positions still to come, thus saving time. In addition, transmission capacities are saved the smaller the amount of data received from external sources.

BRIEF DESCRIPTION OF THE DRAWINGS

In the following, embodiments of the disclosure are described in more detail using the Figures.

Components corresponding to each other are marked with the same reference numerals in the Figures.

DETAILED DESCRIPTION

Figure 1:
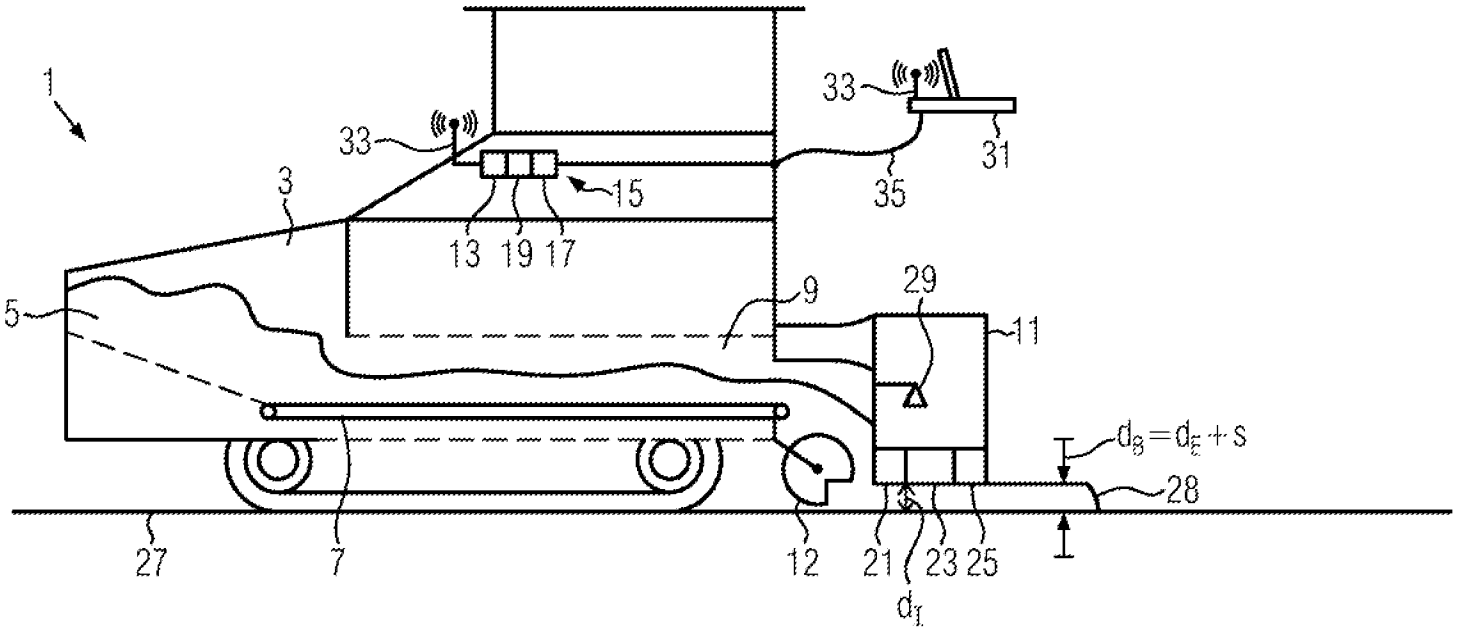
FIG. 1 shows a schematic side view of a road paver.

FIG. 1 shows a schematic side view of a road paver 1, wherein in a lower area in a sectional view a hopper 3 with paving material 5 is shown, and the paving material 5 is conveyed by a material conveyor 7 through a tunnel 9 to the rear in front of a paving screed 11, where it is evenly distributed by an auger 12. The road paver 1 also includes a GNSS receiver 13 which is connected to an electronic control system 15. The electronic control system 15 comprises a memory 17 and a data processor 19. The paving screed 11 comprises a tamper 21, a screed plate 23, and a pressure bar 25, wherein a plurality of these components may also be present. The paving material 5 is pre-compacted by means of the paving screed 11 and paved on a roadbase 27 as road surface 28 with a layer thickness $d_B$, which in ideal operation corresponds to the target layer thickness $d_S$, wherein the target layer thickness $d_S$ is higher by one rolling dimension s than the desired final layer thickness $d_E$, which is present after post-compaction by a roller. A sensor 29, which can be attached to the paving screed 11 or to the chassis of the road paver 1, is used to measure the actual layer thickness $d_I$ of the paving material 5. The sensor 29 can also be attached in such a way that it measures the actual layer thickness $d_I$ while paving, thus enabling the paving screed 11 to be readjusted. An external data processing system 31, e.g., a laptop computer, may be provided for transmitting and receiving construction data, by means of a radio link via antennas 33 on the road paver 1 and on the data processing system 31, wherein the antennas 33 may also be suitable for receiving satellite signals for position determination, or via a cable connection 35.

Figure 2:
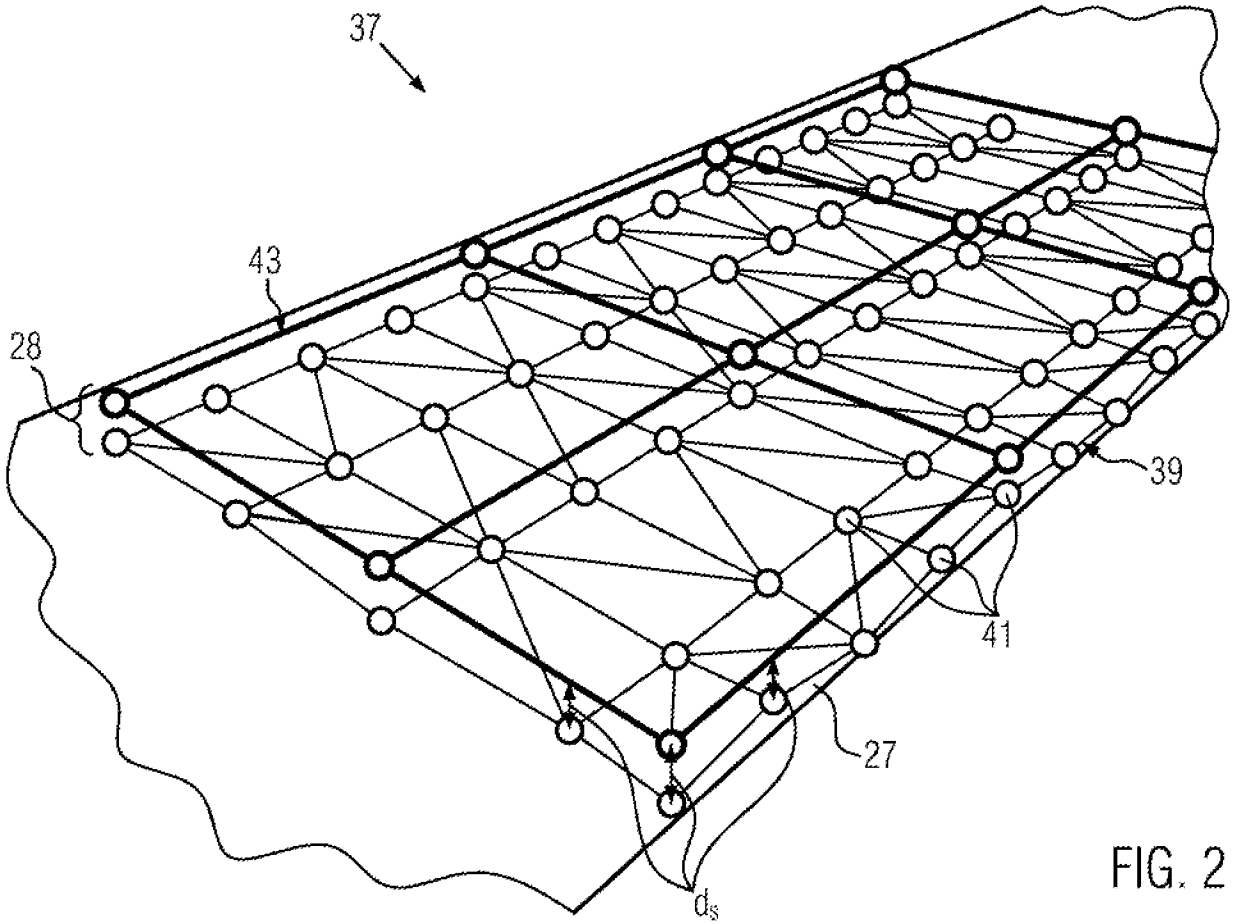
FIG. 2 shows a three-dimensional view of construction data.

FIG. 2 shows a three-dimensional view of digital construction data 37. The roadbase 27 has a height profile 39, which includes height data for individual local coordinate points 41. This height profile 39 may have been obtained from a previous surface scan using an external vehicle. However, it is also possible that a scanning device is attached to the road paver 1 itself and the surface scan is carried out for a part of the roadbase 27 further forward in the direction of travel, while paving material 5 is already being paved in a rear part based on the digital construction data 37 already obtained. The data of the height profile 39 of the roadbase 27 are enriched with the data of a target height profile 43 of the road pavement 28 to be paved. In accordance with the elevations and depressions of the height profile 39 of the roadbase 27, the different target layer thicknesses $d_S$ are thus stored for the respective local coordinate points 41. The number of data points or local coordinate points 41, for which roadbase and road surface data are stored, can vary depending on the technical specifications for data collection and processing, for example the accuracy of the GNSS, and thus represents a form of "resolution." It is also conceivable that the processing of the digital construction data 37 includes algorithms that distinguish areas with frequent and/or more severe irregularities in the roadbase 27 from areas with little change and proportionally adjust the number of data points, thereby maintaining a high information density on the one hand and reducing the data volume on the other. The position of the data points 41 in the grid can be influenced by a sensor position. The digital construction data 37 includes further data, which were calculated in particular on the basis of the measured data, such as the height profile 39 of the roadbase 27, such as a desired compaction degree per local coordinate point 41.

Figure 3:
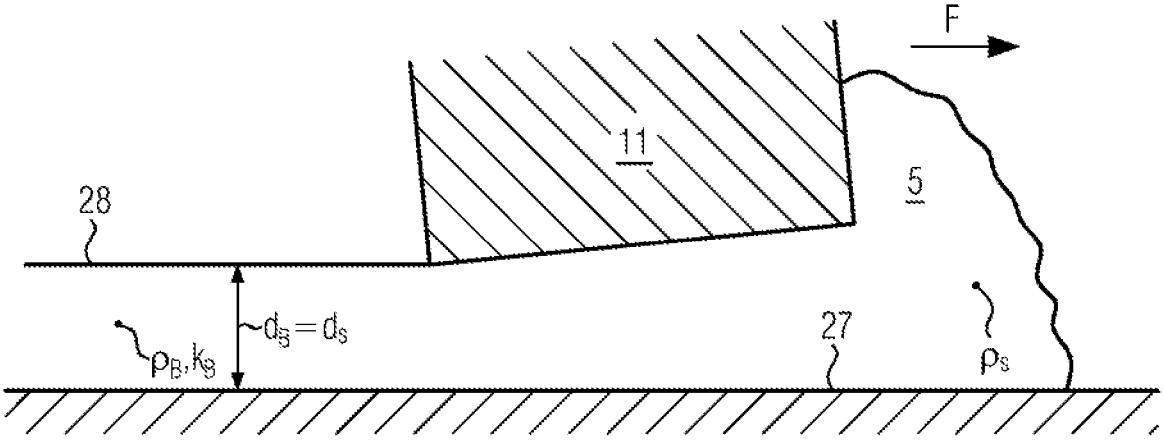
FIG. 3 shows a schematic view of screed compaction of paving material on a level roadbase.

FIG. 3 shows a schematic view of screed compaction of paving material 5 on a level roadbase 27. The paving material 5 is deposited by the material conveyor 7 and auger 12 in front of the paving screed 11 with a bulk density $\rho_S$. The paving screed 11, which is pulled by the road paver 1 in direction of travel F, compacts the paving material 5 to a screed density $\rho_B$ and a layer thickness $d_B$ equal to the target layer thickness $d_S$ for screed paving, thus paving the road surface 28. In the case of a level roadbase 27, the paving screed 11 can be used without any major changes to the paving parameters once set.

Figure 4:
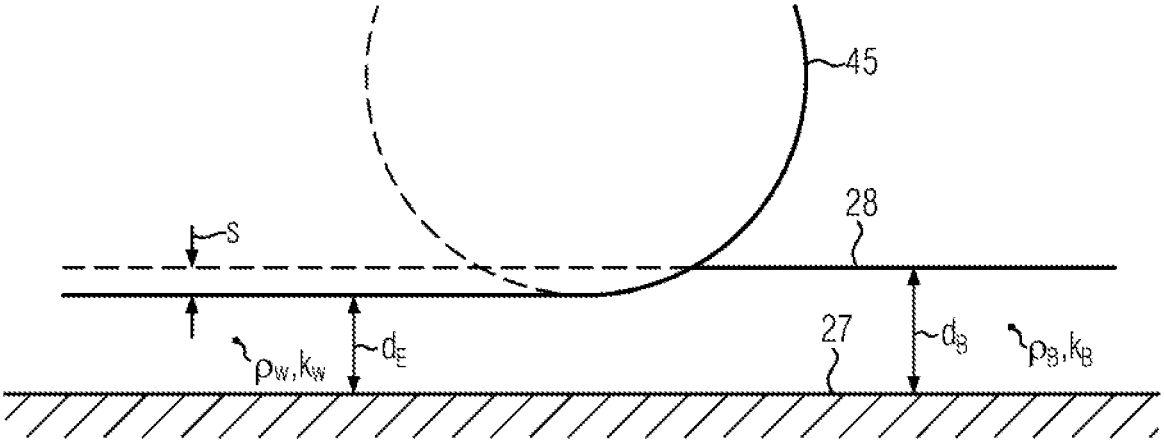
FIG. 4 shows a schematic view of roller compaction of paving material on level roadbase.

FIG. 4 shows a schematic view of the roller compaction of paving material 5 or the road surface 28 paved by the paving screed 11 on a level roadbase 27. The layer thickness $d_B$ is reduced by the rolling dimension s to the final layer thickness $d_E$ for which the roller 45 performs one or more runs. The density of the pavement material 5 increases to the rolling density pw. Accordingly, a compaction degree can be specified for paving screed 11 and roller 45:

$$\text{Compaction degree } k_B \text{ of paving screed} = k_B = \frac{\rho_B}{\rho_M} * 100\%$$

$$\text{Compaction degree } k_W \text{ of roller} = k_W = \frac{\rho_W}{\rho_M} * 100\%$$

Here, $\rho_M$ is the density of the Marshall test specimen, which is produced with a compaction device under laboratory conditions. The density $\rho_M$ essentially corresponds to the maximum density of the paving material 5, i.e., the compaction degree $k_B$, $k_W$ indicates the percentage of the maximum density $\rho_M$ to which the paving material 5 is brought by the respective machine, paving screed 11 or roller 45.

Figure 5:
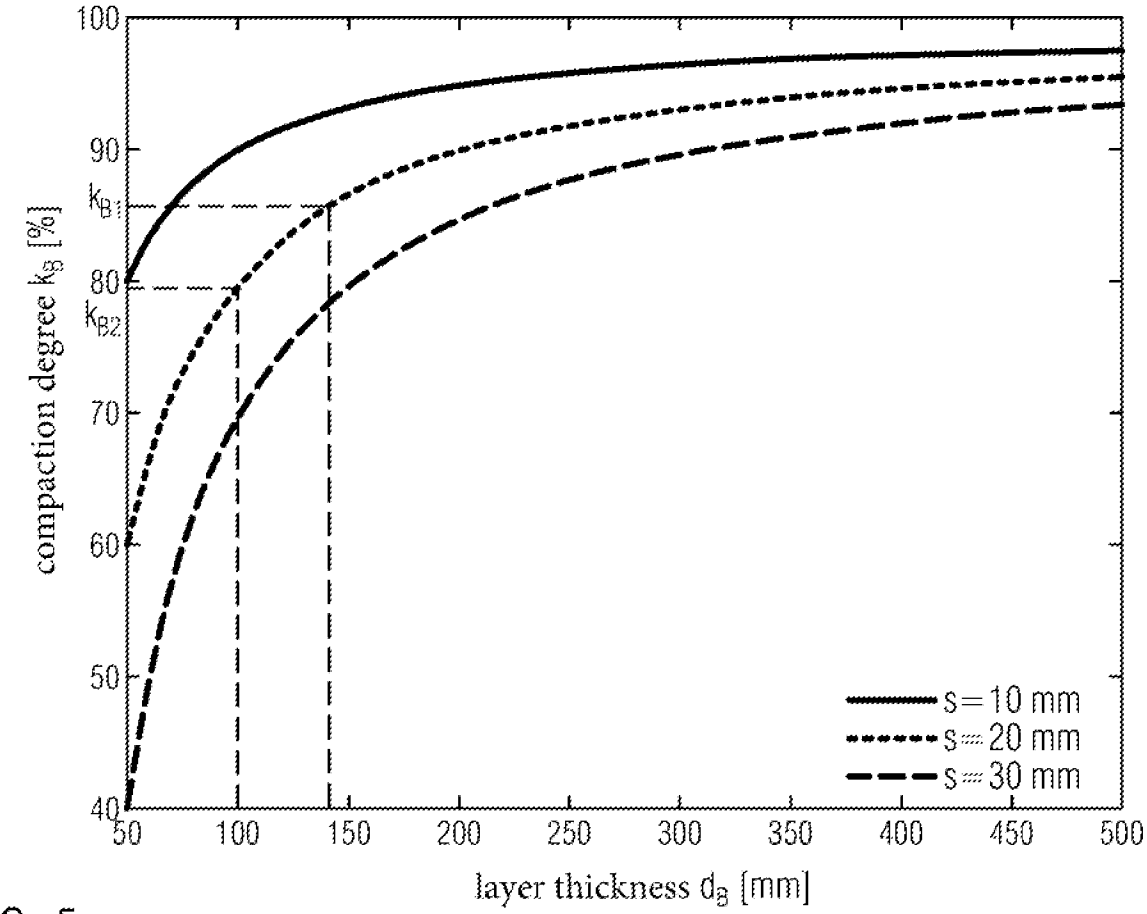
FIG. 5 shows the graphic representation of the change in compaction degree of the paving screed as a function of layer thickness at constant rolling dimension.

FIG. 5 shows the graphical representation of the change in compaction $k_B$ as a function of layer thickness $d_B$ of the paving screed 11 at constant rolling dimension s according to equation 1, which is derived as follows:

It applies generally:

$$\rho = \frac{m}{V} = \frac{m}{b * x * d}$$

with m, b, x=const. and m=mass, b=width, x=length in driving direction and d=layer thickness of the considered section of the road surface 28.

Further applies thus:

$$k = \frac{\rho_1}{\rho_2} = \frac{d_1}{d_2}$$

It follows that, assuming that after final compaction of the road surface by the roller, the material density $\rho_W$ corresponds approximately to the Marshall density $\rho_M$ for the compaction degree $k_B$ of the road surface $$k_B = \frac{\rho_B}{\rho_W} = \frac{\rho_B}{\rho_M} = \frac{d_W}{d_B} \text{ with } \rho_W \approx \rho_M$$

With $$\text{rolling dimension } s = d_B - d_W \rightarrow d_W = d_B - s$$

follows:

$$k_B = \frac{d_B - s}{d_B} \qquad \text{Equation 1}$$

As the layer thickness $d_B$ is predetermined and varies due to the irregularities of the roadbase 27, the compaction degree $k_B$ must be adjusted according to FIG. 5 in order to obtain the same rolling dimension s for all layer thicknesses $d_B$, i.e., to remain on the corresponding functional curve (s=10 mm, 20 mm, 30 mm) in FIG. 5.

Figure 6:
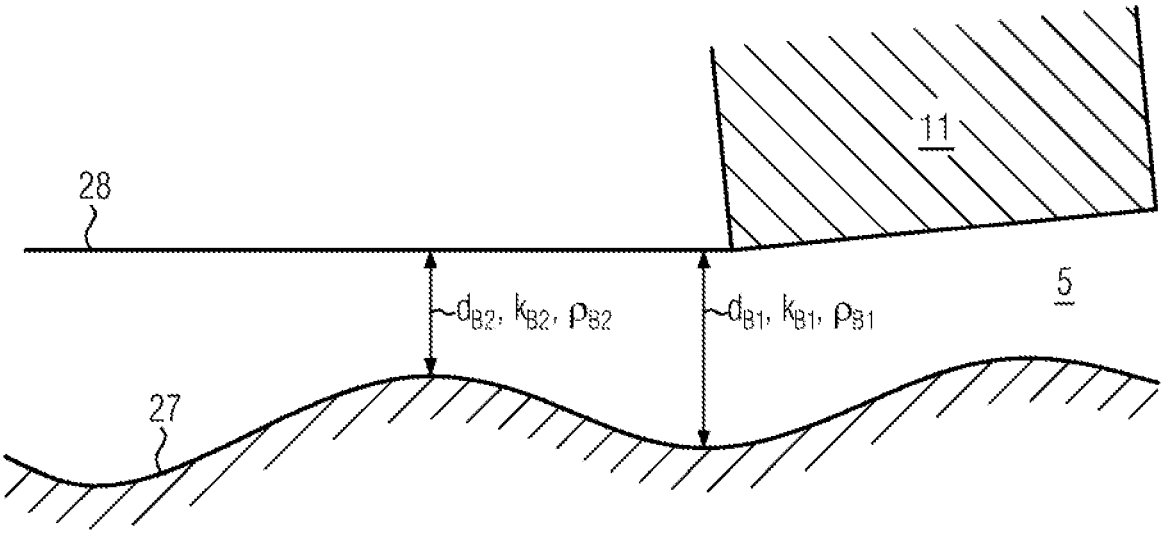
FIG. 6 shows a schematic view of screed compaction of paving material on an irregular roadbase.

FIG. 6 shows a schematic view of screed compaction of paving material 5 on irregular roadbase 27. The layer thicknesses $d_{B1}$ and $d_{B2}$ are specified to obtain a level road pavement 28 at a desired level. The rolling dimension s, by which the height of the road surface 28 is reduced by the rolling compaction, is purposefully taken into account. The respective compaction degrees $k_{B1}$ and $k_{B2}$ are calculated according to equation 1. The electronic control system 15 is capable of controlling the compaction performance of paving screed 11 by activating one or a plurality of the compaction units 21, 23, 25, thus producing the respective calculated degree of compaction $k_B$ at the point known from the three-dimensional construction data 37. The compaction ratio $k_B$ and thus the density $\rho_B$ depending on the layer thickness $d_B$ is paved in order to achieve a uniform rolling dimension s everywhere during subsequent post-compaction by roller 45.

Figure 7:
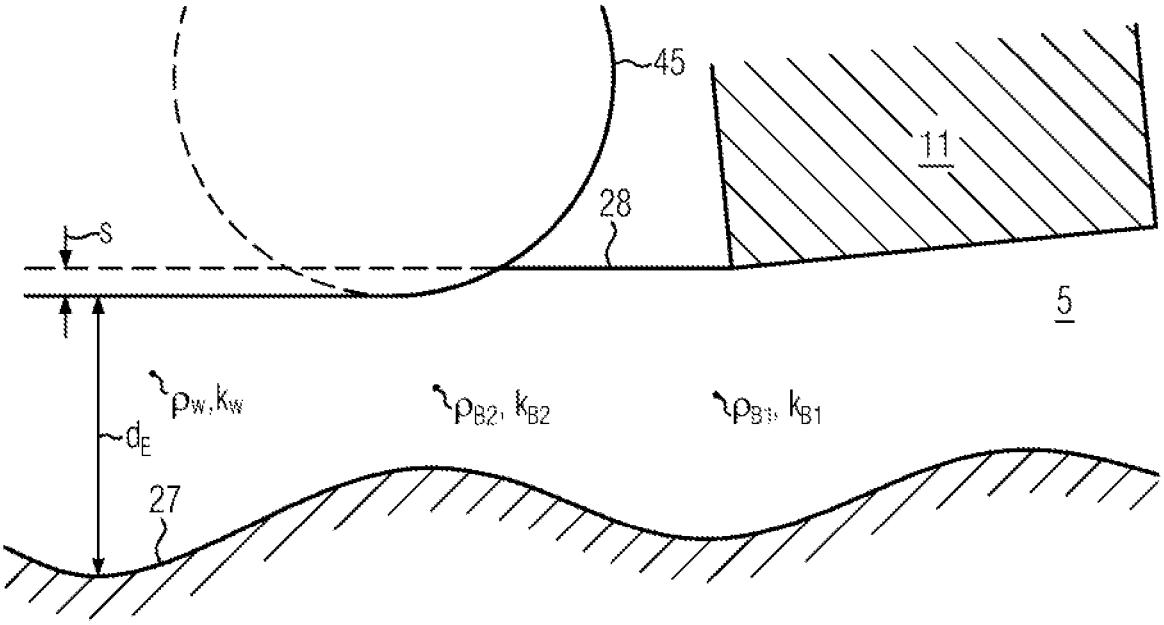
FIG. 7 shows a schematic view of roller compaction of paving material on an irregular roadbase.

FIG. 7 shows a schematic view of the roller compaction of paving material 5 on irregular roadbase 27. The rolling dimension s is the same everywhere due to the adapted compaction degrees $k_{B1}$, $k_{B2}$. The road surface 28, which has already been paved by paving screed 11, is thus compacted by roller 45 while maintaining the longitudinal levelness. After roller compaction, the road surface 28 has a uniform density $\rho_W$, a uniform compaction degree $k_W$ and a final layer thickness $d_E$ that varies in accordance with the roadbase 27.

What is claimed is:

1. A road paver comprising:

a paving screed including a tamper;

a GNSS receiver;

a material conveyor; and an electronic control system comprising a memory and a data processor, wherein in the memory digital construction data are stored including a target layer thickness of paving material and a pre-compaction degree that depends on the target layer thickness for a respective local coordinate point, and the control system is configured to automatically control compaction performance of the paving screed as a function of the target layer thickness in order to pave the paving material with the pre-compaction degree for the respective local coordinate point of the road paver determined with the GNSS receiver.

2. The road paver according to claim 1, wherein the digital construction data further comprise a target height profile of a road surface to be produced.

3. The road paver according to claim 1, wherein the control system is configured to automatically adjust the compaction performance of the paving screed by controlling paving speed.

4. The road paver according to claim 1, wherein the digital construction data further comprise a height profile of a roadbase on which the paving material is to be paved.

5. The road paver according to claim 1, wherein the paving screed comprises a screed plate and/or a pressure bar, and the control system is configured to automatically adjust the compaction performance of the paving screed by controlling vibration frequency and/or amplitude of the screed plate and/or pressure of the pressure bar.

6. The road paver according to claim 1, further comprising a sensor for measuring an actual layer thickness of paving material, wherein the control system is configured to calculate a deviation of the actual layer thickness from the target layer thickness.

7. The road paver according to claim 1, wherein the control system is configured to automatically adjust the compaction performance of the paving screed by controlling tamper frequency and/or tamper stroke of the tamper.

8. A method for operating a road paver, the method comprising:

storing digital construction data in a memory of an electronic control system, wherein the digital construction data includes a target height profile of a road surface to be produced, a target layer thickness of a paving material for local coordinate points of a roadbase, and a respective pre-compaction degree depending on the target layer thickness; and paving of the paving material, wherein a current position of the road paver is determined by means of a GNSS receiver and the electronic control system automatically controls compaction performance of a paving screed of the road paver as a function of the target layer thickness in order to pave the paving material at the respective pre-compaction degree depending on the target layer thickness.

9. The method according to claim 8, wherein the paving of the paving material comprises detecting an actual layer thickness of the paving material by a sensor, calculating a difference between the actual layer thickness and the target layer thickness, and automatically controlling the road paver to minimize the difference.

10. The method according to claim 8, wherein the paving screed comprises a tamper, and the electronic control system automatically adjusts the compaction performance of the paving screed by controlling tamper frequency and/or tamper stroke of the tamper.

11. The method according to claim 8, wherein the paving screed comprises a screed plate and/or a pressure bar, and the control system automatically adjusts the compaction performance of the paving screed by controlling vibration frequency and/or amplitude of the screed plate and/or pressure of the pressure bar.

12. The method according to claim 8, wherein the control system automatically adjusts the compaction performance of the paving screed by controlling paving speed.

13. The method according to claim 8, wherein the digital construction data comprising the height profile of the roadbase is transferred at a beginning of the method from an external data processing system to the memory of the electronic control system by means of a radio or cable connection.

14. The method according to claim 8, wherein by means of an external data processing system the compaction performance is calculated as a function of the target layer thickness and/or the compaction performance is assigned to a local point as a function of the target layer thickness and data is then transferred to the memory of the electronic control system.

15. The method according to claim 8, wherein by means of the electronic control system the compaction performance is calculated as a function of the target layer thickness and/or the compaction performance is assigned to a local coordinate point as a function of the target layer thickness.

* * * * *